US010714808B2

(12) United States Patent
Ding et al.

(10) Patent No.: US 10,714,808 B2
(45) Date of Patent: Jul. 14, 2020

(54) TILT ADAPTER FOR DIPLEXED ANTENNA WITH SEMI-INDEPENDENT TILT

(71) Applicant: CommScope Technologies LLC, Hickory, NC (US)

(72) Inventors: Guomin Ding, Suzhou (CN); Martin L. Zimmerman, Chicago, IL (US)

(73) Assignee: Commscope Technologies LLC, Hickory, NC (US)

( * ) Notice: Subject to any disclaimer, the term of this patent is extended or adjusted under 35 U.S.C. 154(b) by 0 days.

(21) Appl. No.: 16/035,773

(22) Filed: Jul. 16, 2018

(65) Prior Publication Data

US 2018/0323491 A1 Nov. 8, 2018

Related U.S. Application Data

(63) Continuation of application No. 14/958,463, filed on Dec. 3, 2015, now Pat. No. 10,033,086, which is a continuation-in-part of application No. 14/812,339, filed on Jul. 29, 2015, now Pat. No. 10,116,425.

(60) Provisional application No. 62/169,782, filed on Jun. 2, 2015, provisional application No. 62/077,596, filed on Nov. 10, 2014.

(51) Int. Cl.

| | |
|---|---|
| ***H01Q 1/12*** | (2006.01) |
| ***H01Q 3/04*** | (2006.01) |
| ***H01Q 3/26*** | (2006.01) |

(52) U.S. Cl.

CPC ..... *H01Q 1/1264* (2013.01); *H01Q 3/04* (2013.01); *H01Q 3/26* (2013.01)

(58) Field of Classification Search

CPC ..... H01Q 1/12; H01Q 5/335; H04L 5/08

See application file for complete search history.

(56) References Cited

U.S. PATENT DOCUMENTS

| | | | |
|---|---|---|---|
| 4,689,627 | A | 8/1987 | Lee et al. |
| 5,440,318 | A | 8/1995 | Butland et al. |
| 6,864,837 | B2 | 3/2005 | Runyon et al. |
| 7,173,572 | B2 | 2/2007 | Teillet et al. |
| 7,312,751 | B1 | 12/2007 | Voyce et al. |
| 2006/0077098 | A1 | 4/2006 | Zimmerman |
| 2006/0109066 | A1 | 5/2006 | Borysenko |
| 2007/0008236 | A1 | 1/2007 | Tillery et al. |
| 2009/0322610 | A1 | 12/2009 | Haskell et al. |

(Continued)

FOREIGN PATENT DOCUMENTS

| | | | |
|---|---|---|---|
| CN | 103311669 | A | 9/2013 |
| CN | 103916021 | A | 7/2014 |

(Continued)

OTHER PUBLICATIONS

EP Examination Report for corresponding Application No. 16179570.3-1927, dated Jan. 2, 2018, 6 pages.

(Continued)

*Primary Examiner* — Jamal Javaid

(74) *Attorney, Agent, or Firm* — Myers Bigel, P.A.

(57) ABSTRACT

A tilt adapter configured to facilitate a desired tilt of a first radio frequency (RF) band and a second RF band of an antenna is disclosed. The antenna supports two or more frequency bands, in which the vertical tilt of each of the supported frequency bands is separately controlled by a coarse level of phase shifting, but commonly controlled by a fine level of phase shifting.

20 Claims, 11 Drawing Sheets

(56) References Cited

U.S. PATENT DOCUMENTS

| | | | | |
|---|---|---|---|---|
| 2010/0201590 | A1* | 8/2010 | Girard | H01Q 1/246 343/766 |
| 2012/0087284 | A1 | 4/2012 | Linehan et al. | |
| 2012/0280882 | A1* | 11/2012 | Zimmerman | H01Q 1/42 343/836 |
| 2013/0214973 | A1 | 8/2013 | Veihl et al. | |
| 2013/0294302 | A1 | 11/2013 | Hofmann et al. | |
| 2014/0062834 | A1 | 3/2014 | Jidhage et al. | |
| 2014/0225792 | A1 | 8/2014 | Lee et al. | |

FOREIGN PATENT DOCUMENTS

| | | |
|---|---|---|
| GB | 2384369 | 7/2003 |
| JP | 2000223926 | 8/2000 |
| WO | 2011026034 A2 | 3/2011 |

OTHER PUBLICATIONS

European Search Report Corresponding to Application No. 16 179 570.3; dated Nov. 29, 2016; 7 pages.

Notification Concerning Transmittal of International Preliminary Report on Patentability Corresponding to PCT/US2015/045008, dated May 26, 2017, 9 pages.

Int'l Search Report & Written Opinion dated Nov. 24, 2015 in Int'l Application No. PCT/US2015/045008.

English Translation of Chinese Office Action for corresponding Chinese Application No. 201610616201.2; dated Mar. 30, 2020, 9 pages.

* cited by examiner

TILT ADAPTER FOR DIPLEXED ANTENNA WITH SEMI-INDEPENDENT TILT

CROSS-REFERENCE TO RELATED APPLICATIONS

This application is a continuation of U.S. patent application Ser. No. 14/958,463, filed Dec. 3, 2015, which, in turn, is a continuation-in-Part of U.S. patent application Ser. No. 14/812,339, filed on Jul. 29, 2015, which claims the benefit of U.S. Provisional Patent Application No. 62/077,596, filed on Nov. 10, 2014, and U.S. Provisional Patent Application No. 62/169,782, filed on Jun. 2, 2015, all of which are incorporated herein by reference in their entirety.

BACKGROUND

Various aspects of the present disclosure relate to base station antennas, and, more particularly, to mechanical devices for controlling semi-independent tilt of diplexed antennas.

Cellular mobile operators are using more spectrum bands, and increasingly more spectrum within each band, to accommodate increased subscriber traffic, and for the deployment of new radio access technologies. Consequently, there is great demand for diplexed antennas that cover multiple closely-spaced bands (e.g., 790-862 MHz and 880-960 MHz). Based on network coverage requirements, operators often need to adjust the vertical radiation pattern of the antennas, i.e., the pattern's cross-section in the vertical plane. When required, alteration of the vertical angle of the antenna's main beam, also known as the "tilt", is used to adjust the coverage area of the antenna. Adjusting the beam angle of tilt may be implemented both mechanically and electrically. Mechanical tilt may be provided by angling the diplexed antenna physically downward, whereas electrical tilt may be provided by controlling phases of radiating signals of each radiating element so the main beam is moved downward. Mechanical and electrical tilt may be adjusted either individually, or in combination, utilizing remote control capabilities.

Network performance may be optimized if the tilt (e.g., electrical tilt) associated with each frequency band supported by an antenna is completely independently controlled. However, this independence may require a large number of diplexers and other components, adding significant cost and complexity to the creation of a diplexed antenna.

Accordingly, it would be advantageous to have a low complexity, cost-effective diplexed antenna able to produce high quality radiation patterns for each of the supported frequency bands and mechanical means for remotely controlling the same.

SUMMARY OF THE DISCLOSURE

Various aspects of the present disclosure are directed to a tilt adapter configured to facilitate a desired tilt of a first radio frequency (RF) band and a second RF band of an antenna. The antenna supports two or more frequency bands, in which the vertical tilt of each of the supported frequency bands is separately controlled by a coarse level of phase shifting, but commonly controlled by a fine level of phase shifting.

In one aspect, the tilt adapter may comprise a first rod coupled to at least one first coarse phase shifter, a second rod coupled to at least one second coarse phase shifter; a cross linkage member operatively engaged to both the first and second rods; a first rack coupled to the cross linkage member; and a second rack coupled to the first rack, at least one first fine phase shifter, and at least one second fine phase shifter. Lateral movement of the first rod or the second rod causes lateral movement of the second rack.

BRIEF DESCRIPTION OF THE SEVERAL VIEWS OF THE DRAWINGS

The following detailed description will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF VARIOUS EMBODIMENTS

Figure 1:
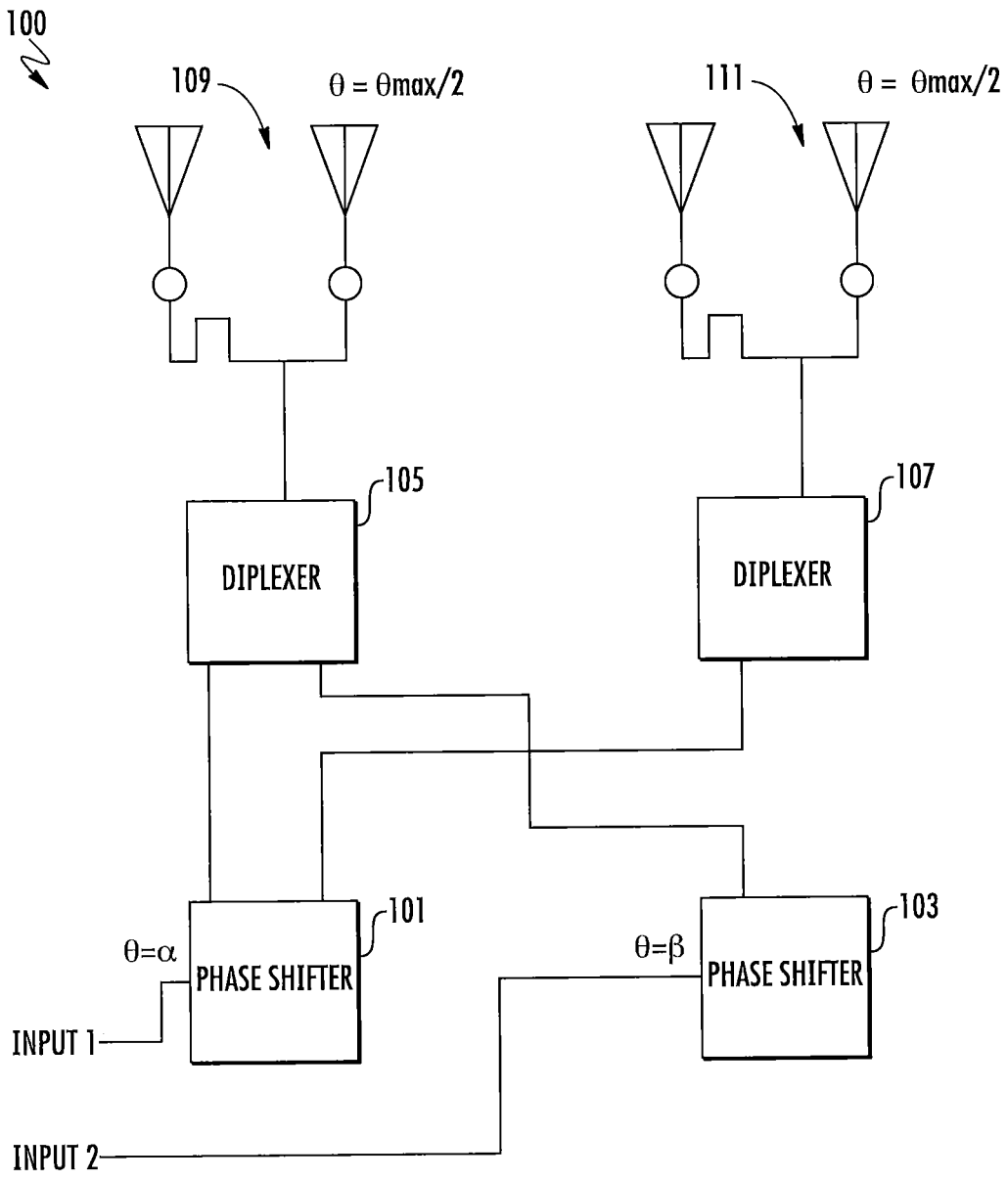
FIG. 1 is a schematic diagram of one example of a diplexed antenna with a simple design.

Certain terminology is used in the following description for convenience only and is not limiting. The words "lower," "bottom," "upper" and "top" designate directions in the drawings to which reference is made. Unless specifically set forth herein, the terms "a," "an" and "the" are not limited to one element, but instead should be read as meaning "at least one." The terminology includes the words noted above, derivatives thereof and words of similar import. It should also be understood that the terms "about," "approximately," "generally," "substantially" and like terms, used herein when referring to a dimension or characteristic of a component of the invention, indicate that the described dimension/characteristic is not a strict boundary or parameter and does not exclude minor variations therefrom that are functionally similar. At a minimum, such references that include a numerical parameter would include variations that, using mathematical and industrial principles accepted in the art (e.g., rounding, measurement or other systematic errors, manufacturing tolerances, etc.), would not vary the least significant digit.

FIG. 1 is a schematic diagram of an example of a diplexed antenna 100. As shown, the diplexed antenna 100 includes first and second first level phase shifters 101, 103 coupled to inputs of respective diplexers 105, 107. Each output of the respective diplexers 105, 107 may be coupled to sub-arrays of radiating elements 109, 111 resulting in a fixed tilt within the sub-arrays of the radiating elements 109, 111. Employing a small number of diplexers, the diplexed antenna 100 exhibits simplicity and may be relatively inexpensive to implement. Unfortunately, the quality of radiation patterns produced by the diplexed antenna 100 may suffer due to some of the phase offsets being fixed.

Figure 2:
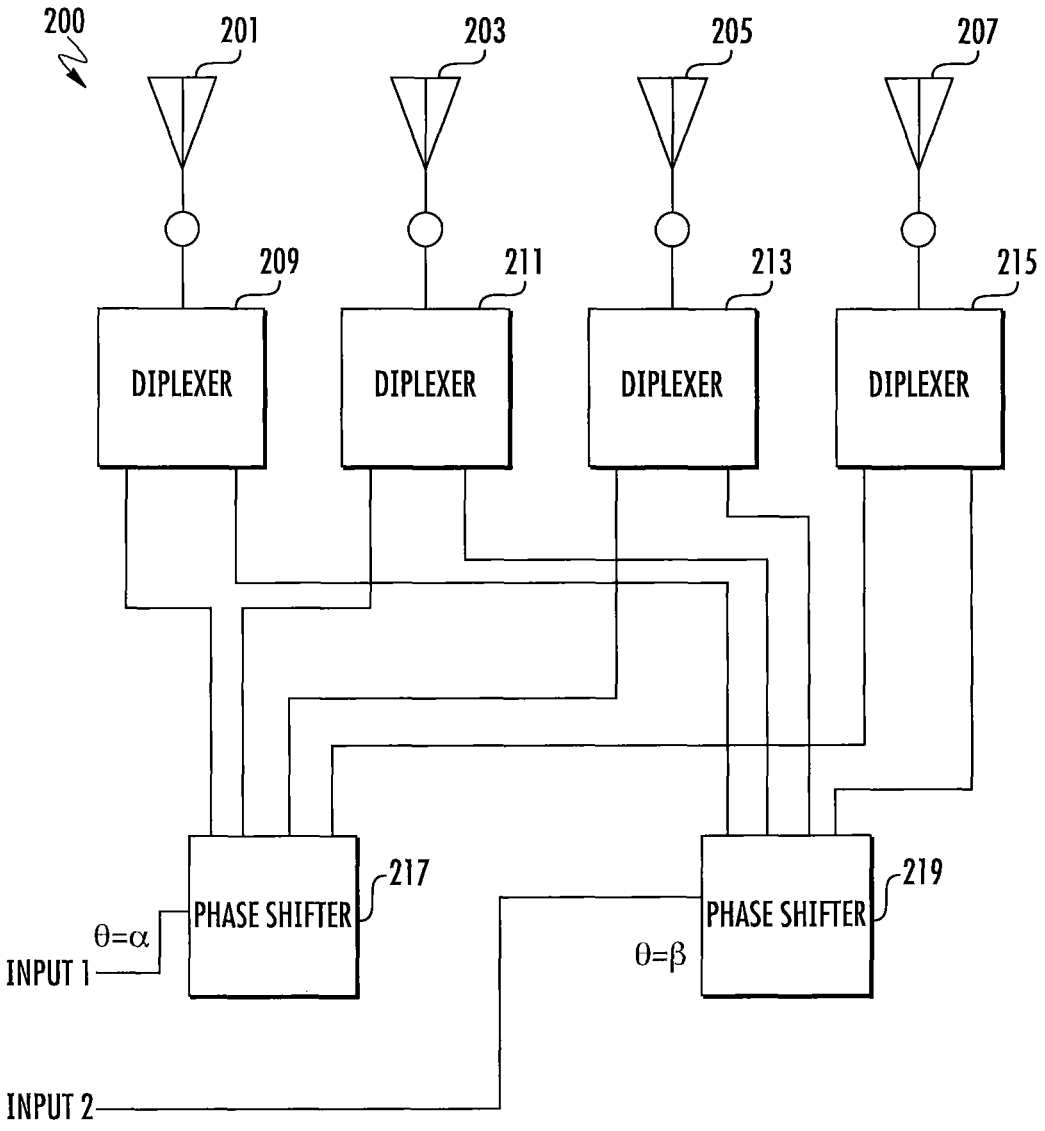
FIG. 2 is a schematic diagram of another example of a diplexed antenna with a more complex design.

Higher quality patterns may be realized when the electrical tilt of each frequency band is completely independently controlled, for example, as shown in a configuration of a four-radiating element diplexed antenna 200 illustrated in FIG. 2. As shown, each radiating element 201, 203, 205, 207 is coupled to a respective diplexer 209, 211, 213, 215, each of which is, in turn, coupled to outputs of each of phase shifters 217, 219. The number of diplexers may double when employing dual polarization functionality. Such diplexed antennas may increase in complexity and cost with greater lengths. For example, diplexed antennas having respective lengths of 1.4, 2.0, and 2.7 meters may require 10, 16, and 20 diplexers respectively, to produce high quality radiation patterns for each of the supported frequency bands.

As evident from the descriptions in connection with FIGS. 1 and 2, for better performance, it may be desirable for diplexed antennas to have an individually controllable tilt for each supported band. While completely individual controllable tilt may be desirable, there may be a significant correlation between (or among) the respective vertical tilt range of each supported band of the diplexed antenna, at least partly due to a frequency band tilt range's dependence on a mount height of the antenna supporting the frequency bands. More specifically, the higher above ground the antenna is mounted, the greater the tilt that may be required for acceptable operation.

Aspects of the present disclosure may take advantage of the above discussed tilt correlation by being directed to a diplexed antenna for processing two or more frequency bands, where the vertical tilt of each of the supported frequency bands may be independently controlled by a coarse level of phase shifting, but commonly controlled by a fine level of phase shifting. As such, aspects of the present disclosure may achieve elevation patterns of a quality similar to that of the diplexed antenna 200 of FIG. 2 above, but at a low cost, light weight, and simplicity similar to that of the diplexed antenna 100 of FIG. 1 above.

Figure 3:
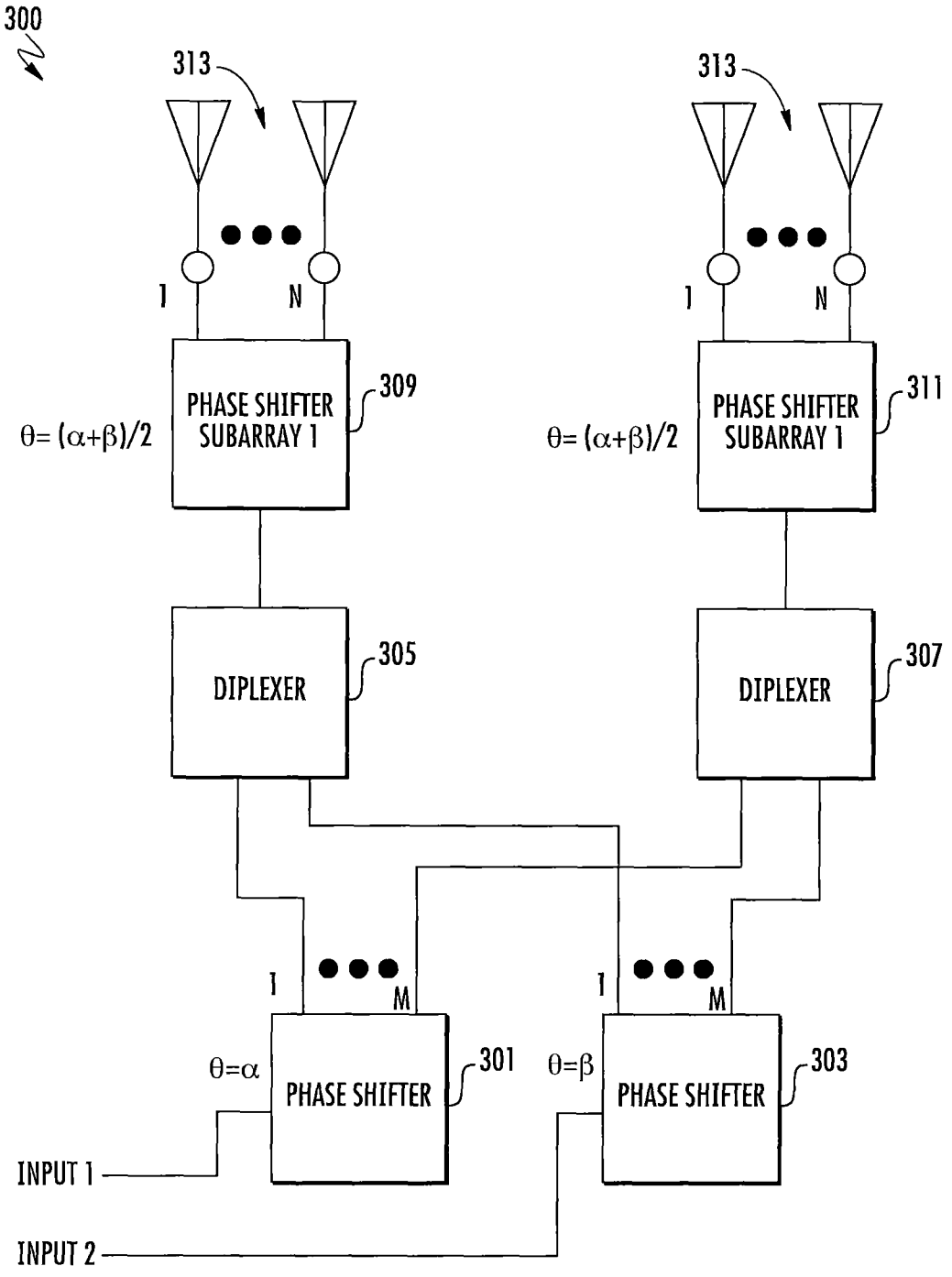
FIG. 3 is a schematic diagram of a further example of a diplexed antenna, according to an aspect of the present disclosure.

Referring now to FIG. 3, according to an aspect of the present disclosure, a diplexed antenna 300 may include first and second coarse phase shifters 301, 303, first and second diplexers 305, 307, first and second fine phase shifters 309, 311, and radiating elements 313, 315. As discussed herein, each of the radiating elements may refer to single radiating elements or a sub-array of multiple radiating elements. The first coarse phase shifter 301 may be set to a tilt value $\alpha$, which may provide a first contribution on a first tilt associated with a first frequency band, while the second coarse phase shifter 311 may be set to a tilt value $\beta$, which may provide a second contribution on a second tilt associated with a second frequency band. For example, the first coarse phase shifter 301 may be configured to receive an RF signal of the first frequency band (e.g., 790-862 MHz), and divide the RF signal into varied phase signals based on the set tilt value $\alpha$. For example, one of the varied phase signals may have a first phase, and another of the varied phase signals may have a second phase different from the first phase. The second coarse phase shifter 311 may be configured to receive an RF signal of the second frequency band (e.g., 880-962 MHz), and divide the RF signal into varied phase signals in a similar fashion to that of the first coarse phase shifter 301.

The diplexers 305, 307 may be configured to diplex the varied phase signals output from the coarse phase shifters 301, 311. For example, the diplexer 305 may be configured to receive one or more varied phase signals output from the first coarse phase shifter 301, as well as one or more varied phase signals output from the second coarse phase shifter 303. Outputs from each of the diplexers 305, 307 may direct communication signals according to the first and second frequency bands.

An output from each of the first and second diplexers 305, 307 may be coupled to inputs of first and second fine phase shifters 309, 311 respectively. The first and second fine phase shifters 309, 311 may be configured to provide phase shifting among the radiating elements 313, 315. The first and second fine phase shifters 309, 311 may allow for operation on all of the supported frequency bands of the diplexed antenna with equal effect. More specifically, the first and second fine phase shifters 309, 311 may be configured to provide a phase shift based on the average of the set tilt values $\alpha°$ and $\beta°$ of the supported frequency bands, or $(\alpha°+\beta°)/2$. To aid in the suppression of sidelobes of produced radiation patterns, each of the coarse and fine phase shifters may include a power divider (such as, for example, a Wilkinson power divider, not shown) to effect a tapered amplitude distribution (e.g., a linear phase progression) across the radiating elements 313, 315.

Figure 4:
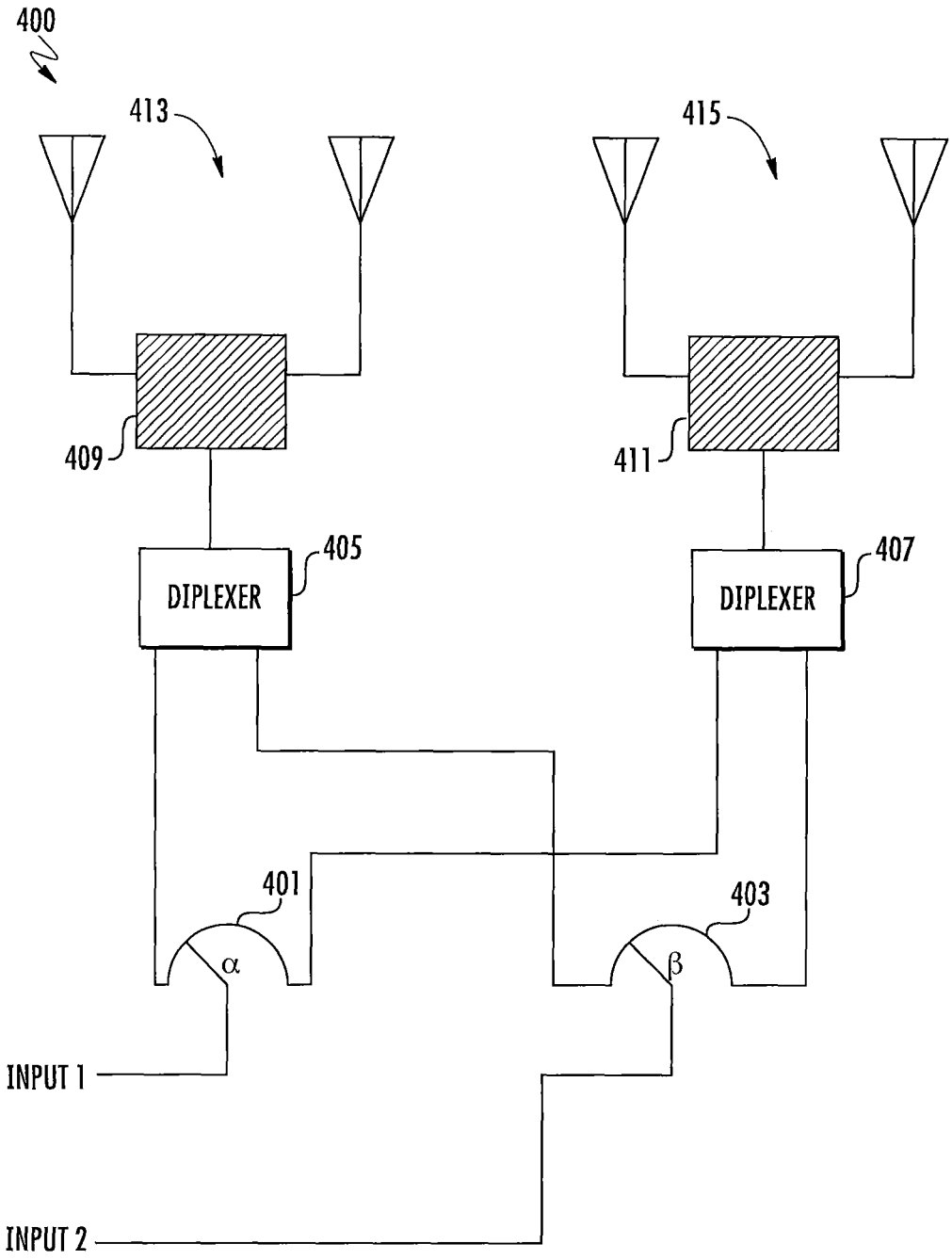
FIG. 4 is a schematic diagram of a diplexed antenna using wiper arc and sliding dielectric phase shifters, according to an aspect of the present disclosure.

Referring now to FIG. 4, the first and second coarse phase shifters 401, 403 of a diplexed antenna 400, for example, may take the form of wiper-arc phase shifters, such as described in U.S. Pat. No. 7,463,190, the contents of which are incorporated herein in their entirety. Wiper-arc phase shifters may be preferred for coarse phase shifting due at least in part to their ability to generate a large phase shift in a small amount of area. The first and second fine phase shifters 409, 413 may take the form of sliding dielectric phase shifters or wiper arc phase shifters, as known in the art, to effect a tilt value of $(\alpha°+\beta°)/2$, as discussed above. Sliding dielectric phase shifters may be preferred, due at least in part, to their ease of allowance of differing power levels across respective outputs, which may be conducive to implementing a taper across an aperture of the diplexed antenna. Other types of phase shifters as known in the art may be employed in keeping with the spirit of the disclosure. Similar to the diplexed antenna 400, according to aspects of the present disclosure, to aid in the suppression of sidelobes of produced radiation patterns, each of the coarse and fine phase shifters may include a power divider (such as, for example, a Wilkinson power divider, not shown) to effect a tapered amplitude distribution across sub-arrays of radiating elements 413, 415.

Figure 5A:
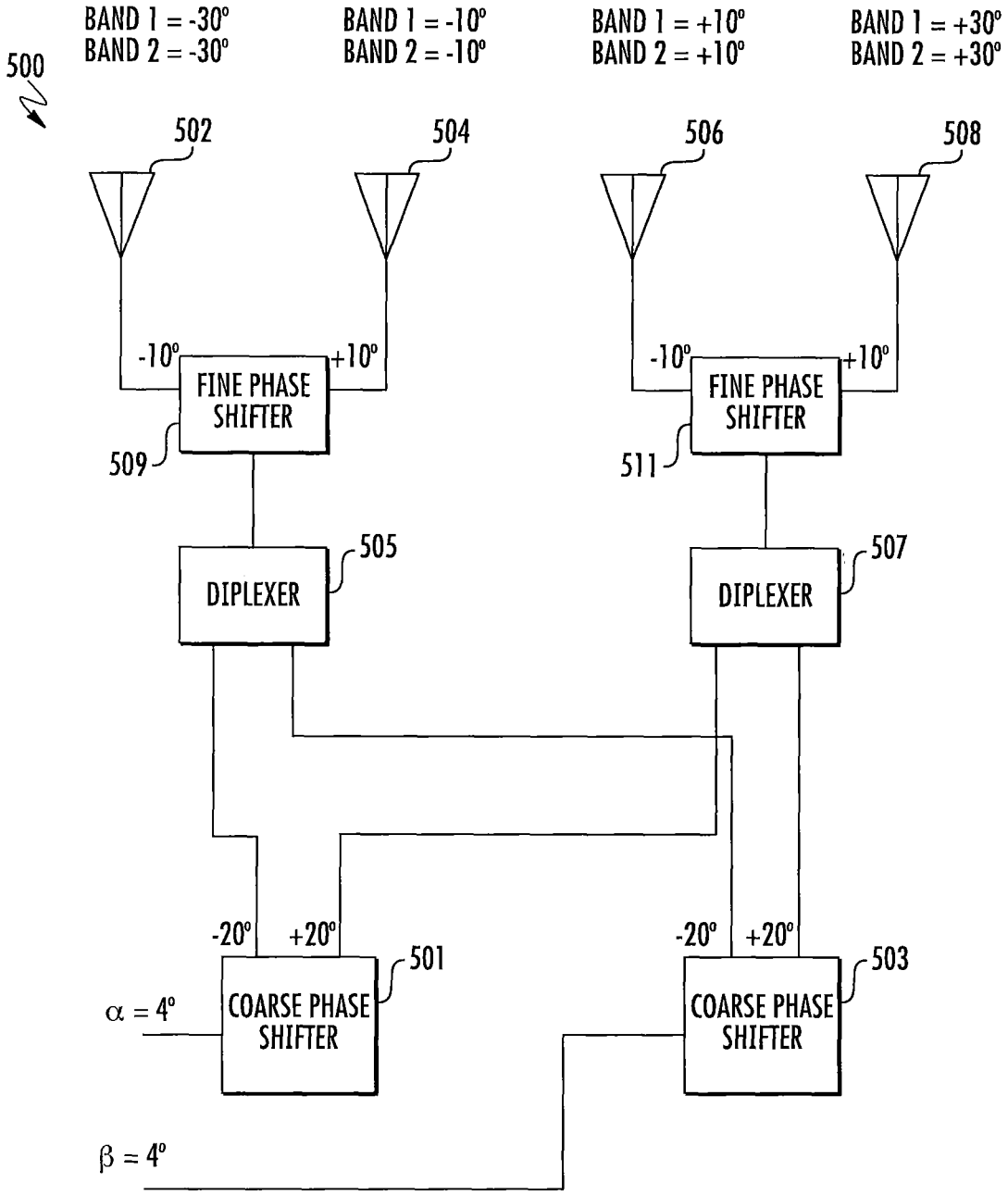
FIG. 5A is a schematic diagram of an example of a diplexed antenna having a length of 1.0 meters, with the first and second frequency bands having the same desired downtilt of 4°, according to an aspect of the present disclosure.
Figure 5B:
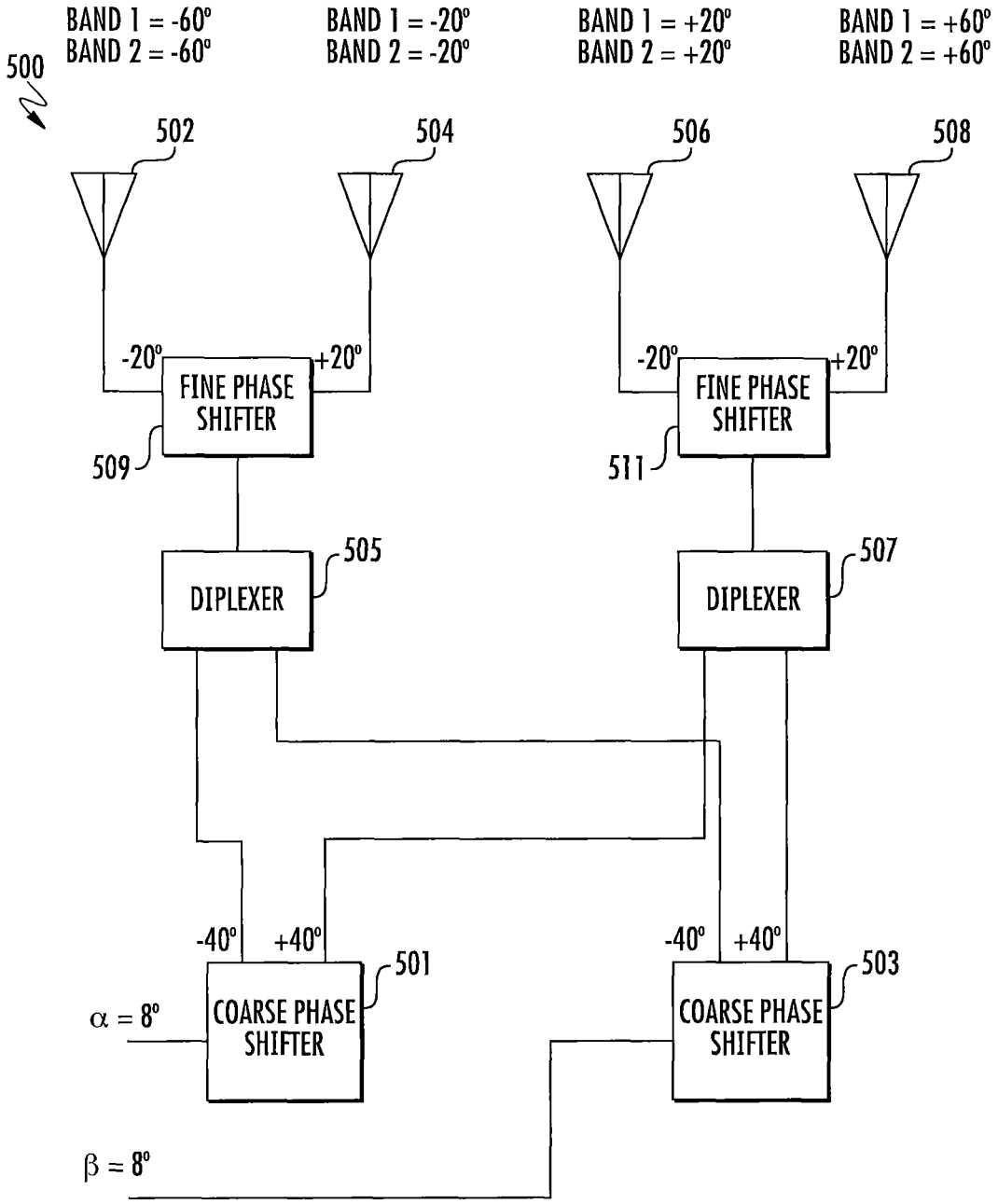
FIG. 5B is a schematic diagram of an example of a diplexed antenna having a length of 1.0 meters, with the first and second frequency bands having the same desired downtilt of 8°, according to an aspect of the present disclosure.
Figure 5C:
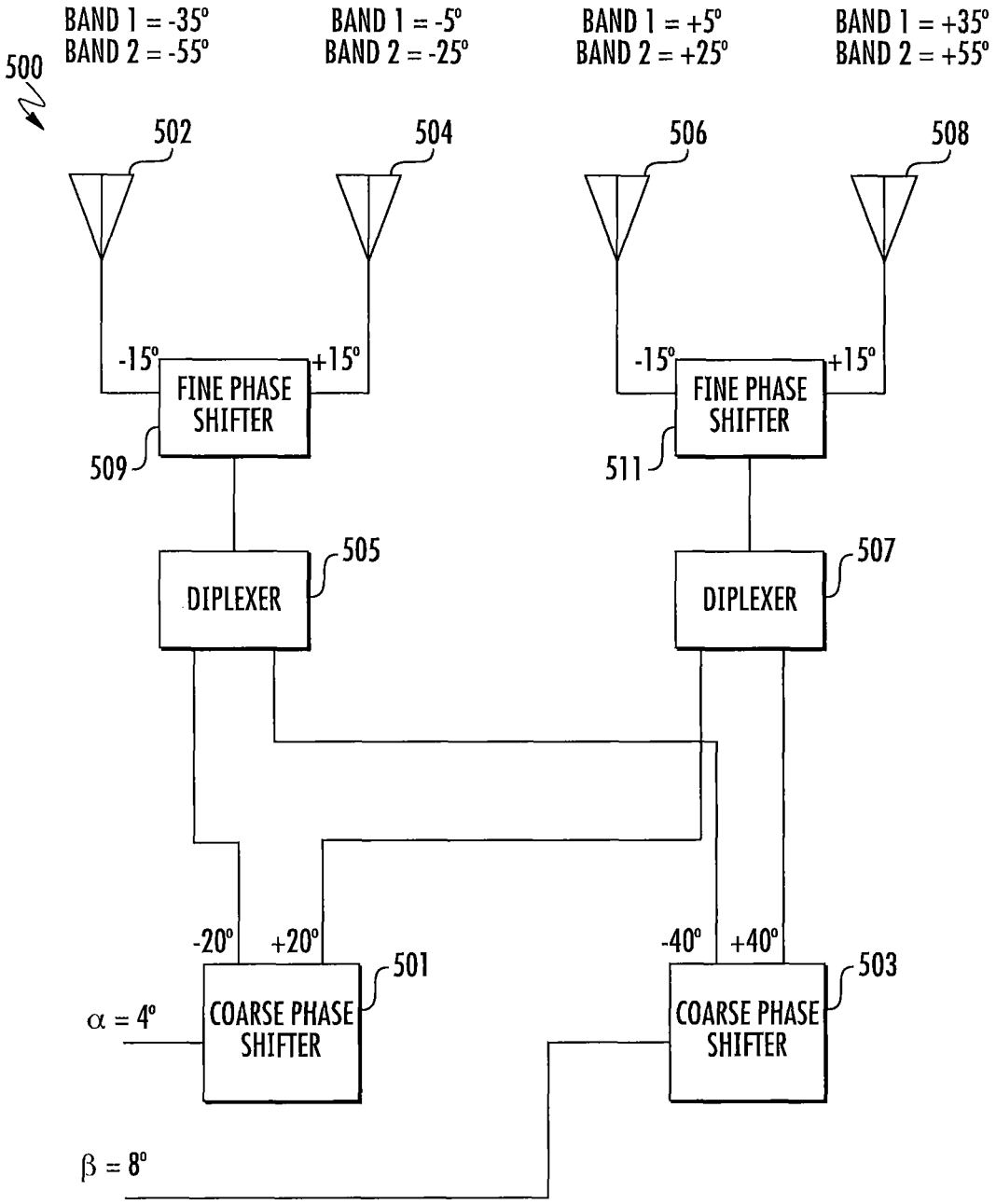
FIG. 5C is a schematic diagram of an example of a diplexed antenna having a length of 1.0 meters, with the first frequency band having a desired downtilt of 4° and the second frequency band having a desired downtilt of 8°, according to an aspect of the present disclosure.

Aspects of the present disclosure may be directed to various antenna lengths, which may incorporate the use of additional components (e.g., diplexers and phase shifters with additional outputs). For example, FIGS. 5A-5C are examples of diplexed antennas 500. As shown, the diplexed antenna 500 may comprise first and second coarse phase shifters 501, 503, first and second diplexers 505, 507, first and second fine phase shifters 509, 511, and radiating elements 502, 504, 506, 508.

The first coarse phase shifter 501 may be set to tilt value α, which may provide a first contribution on a first tilt associated with a first frequency band, while the second coarse phase shifter 503 may be set to tilt β, which may provide a second contribution on a second tilt associated with a second frequency band. For example, the first coarse phase shifter 501 may be configured to receive an RF signal of the first frequency band and divide the RF signal into varied phase signals based on the set tilt value α. For example, one of the variable phase signals may have a first phase, and another of the variable phase signals may have a second phase different from the first phase. The second coarse phase shifter 503 may be configured to receive an RF signal of the second frequency band, and may divide the RF signal into varied phase signals in a similar fashion to that of the first coarse phase shifter 501.

The diplexers 505, 507 may be configured to diplex the varied phase shifted signals output from the coarse phase shifters 501, 503. For example, the diplexer 505 may be configured to receive one or more varied phase signals output from the first coarse phase shifter 501, as well as one or more varied phase signals output from the second coarse phase shifter 503.

Outputs from each of the diplexers 505, 507 may direct communication signals responsive to the first and second frequency bands. An output of each of the first and second diplexers 505, 507 may be coupled to inputs of first and second fine phase shifters 509, 511 respectively. The first and second fine phase shifters 509, 511 may be configured to provide phase shifting among radiating elements 502, 504, 506, 508. The first and second fine phase shifters 509, 511 may allow for operation on all of the supported frequency bands of the diplexed antenna with equal effect. More specifically, the first and second fine phase shifters 509, 511 may be configured to provide a phase shift based on a combination of the set tilt values α and β of the respective coarse phase shifters 501, 503. This combination, may, for example, include an average of the set tilt values α° and β° of the supported frequency bands, or (α°+β°)/2. To aid in the suppression of sidelobes of produced radiation patterns, each of the coarse phase shifters 501, 503 and fine phase shifters 509, 511 may include a power divider (such as, for example, a Wilkinson power divider, not shown) to effect a tapered amplitude distribution across the radiating elements 502, 504, 506, 508.

According to aspects of the present disclosure, a tilt value θ may be related to a phase shift generated by each of the phase shifters. For example, phase shift=sin(θ)*S*k, where S=a distance between radiating elements in degrees (wavelength=360°), and k=distance between phase shifter outputs measured in element spacings. For small values of downtilt, sin(Θ)*S≈Θ*sin(1)*S≈0175*Θ*S.

In the configurations illustrated in FIGS. 5A-5C, each coarse phase shifter 501, 503 may include outputs that are two element spacings apart (i.e., k=2). For example, according to the diplexed antenna 500 in FIGS. 5A-5C, each coarse phase shifter 501, 503 may shift every 2 radiating elements. Each fine phase shifter 509, 511 may include outputs that are one element spacing apart (i.e., k=1). For example, according to the diplexed antenna 500 in FIGS. 5A-5C, each fine phase shifter 509, 511 may shift every radiating element. The distance between radiating elements, S, may typically be between 250°-300°. However, S may be other values outside this range in keeping with the invention. With a value of S in the range of 250°-300°, sin(1)*S≈5°. It should be noted that each of the coarse phase shifters 501, 503 may include outputs that may be fewer or greater than two element spacings apart in keeping with the disclosure. Further, it should be noted that each of the fine phase shifters 509, 511 may include outputs that are greater than one element spacing apart in keeping with the disclosure. It should also be noted that, particularly with other configurations (e.g., diplexed antenna 600, 700, 800, 900, 1000, and the like), other coarse and fine phase shifters may include outputs that are any number of element spacings apart in keeping with the spirit of the disclosure.

Referring to FIG. 5A, when the set tilt value for each frequency band is equal (e.g., α=β=4°), the diplexed antenna may exhibit accuracy similar to that of each of the supported bands having completely independent tilt. Therefore, using the above equation, the phase shift generated by the first coarse phase shifter 501=α*sin(1)*S*k=4*5*2=40°. Therefore, the first coarse phase shifter 501 may generate a pair of varied phase signals varied by 40° in phase. This variation in phase shift may be realized by having one of the outputs of the first coarse phase shifter 501 having a phase of −20° and the other having a phase of +20°. However, it should be noted that other phase shifts may be employed in keeping with the disclosure.

With α=β=4°, the first and second fine phase shifters 509, 511 may be configured to generate a phase shift based on a combination of the set tilt values of the supported bands of the diplexed antenna. For example, the first and second fine phase shifters 509, 511 may be configured to generate a phase shift based on an average of the set tilt values α=β=4°, which in this case, would be 4°. As such, according to the above equation, the phase shift generated by each of the first and second fine phase shifters 509, 511 may be 20°, which may result in a phase progression across the outputs of each of first and second fine phase shifter outputs 509, 511, of 10° and +10°. Table 1 below provides a list of phase shifts applied to each radiating element 502, 504, 506, 508 as attributed to each phase shifter, and the total phase shift applied to each radiating element 502, 504, 506, 508, with such a configuration.

TABLE 1

| α = β = 4° | | | | |
|---|---|---|---|---|
| Radiating Element # | 502 | 504 | 506 | 508 |
| Coarse phase shifters 501, 503 | −20° | −20° | +20° | +20° |
| Fine phase shifters 505, 507 | −10° | +10° | −10° | +10° |
| Total phase shift | −30° | −10° | +10° | +30° |

Alternatively, as shown in FIG. 5B, if α=β=8°, the phase shift generated by the first and second coarse phase shifters 501, 503=α*sin(1)*S*k=8*5*2=80°. Therefore, each of the first and second coarse phase shifters 501, 503 may generate a phase shift of 80°. For example, the output signals of the first and second coarse phase shifters 501, 503 may have a phase −40° and +40° respectively. However, it should be noted that other phase shifts may be employed in keeping with the disclosure. The first and second fine phase shifters 509, 511 may be configured to generate a phase shift based on the average of the set tilt values α and β, which would, in this case, be 8°. As such, according to the above equation, the phase shift generated by each of the first and second fine phase shifters 509, 511 may be 40°, which may be realized with one of the output signals having a phase of −20° and the other of the output signals having a phase of +20°. Table 2 below lists phase shifts applied to each radiating element 502, 504, 506, 508 as attributed to each phase shifter, and the total phase shift applied to each radiating element 502, 504, 506, 508:

TABLE 2

| $\alpha = \beta = 8°$ | | | | |
|---|---|---|---|---|
| Radiating Element # | 502 | 504 | 506 | 508 |
| Coarse phase shifters 501, 503 | −40° | −40° | +40° | +40° |
| Fine phase shifters 505, 507 | −20° | +20° | −20° | +20° |
| Total phase shift | −60° | −20° | +20° | +60° |

As shown in FIG. 5C, according to aspects of the present disclosure, when the desired tilts for the supported bands differ, performance may only slightly degrade, but may still be acceptable. For example, with the set tilts $\alpha$=4° and $\beta$=8°, the fine phase shifters 509, 511 for both supported frequency bands may be configured to generate a phase shift based on the average set tilt values, which in this case would be $(\alpha+\beta)/2$=6°. Therefore, according to the above equation, the phase shift generated by each of the first and second fine phase shifters 509, 511 would be 6*5*1, which may result in a phase shift of 30°, which may be realized with a linear phase progression across the outputs of the first and second fine phase shifters 509, 511 of −15° and +15°. Table 3 below lists phase shifts applied to each radiating element 502, 504, 506, 508 as attributed to each phase shifter, and the total phase shift applied to each radiating element 502, 504, 506, 508, for this first band with tilt values $\alpha$=4° and $\beta$=8°.

TABLE 3

| Phase for band 1: $\alpha$ = 40°, $\beta$ = 8° | | | | |
|---|---|---|---|---|
| Radiating Element # | 502 | 504 | 506 | 508 |
| Coarse phase shifters 501, 503 | −20° | −20° | +20° | +20° |
| Fine phase shifters 505, 507 | −15° | +15° | −15° | +15° |
| Total phase shift | −35° | −5° | +5° | +35° |

Table 4 below lists phase shifts applied to each radiating element 502, 504, 506, 508 as attributed to each phase shifter, and the total phase shift applied to each radiating element 502, 504, 506, 508, for the second frequency band with tilt values $\alpha$=4° and $\beta$=8°.

TABLE 4

| Phase for band 2: $\alpha$ = 4°, $\beta$ = 8° | | | | |
|---|---|---|---|---|
| Radiating Element # | 502 | 504 | 506 | 508 |
| Coarse phase shifters 501, 503 | −40° | −40° | +40° | +40° |
| Fine phase shifters 505, 507 | −15° | +15° | −15° | +15° |
| Total phase shift | −55° | −25° | +25° | +55° |

Through analysis of the above data, the total phase shifts of the radiating elements 502, 504, 506, 508 of the dual band implementations of the diplexed antenna listed in Tables 3 and 4 may be relatively close to the ideal (e.g., effectively completely independent tilt implementations, as reflected in Tables 1 and 2) phase shifts of the radiating elements 502, 504, 506, 508. Consequently, aspects of the present disclosure may be able to achieve elevation patterns of a quality similar to that of more complex diplexed antenna.

Figure 6:
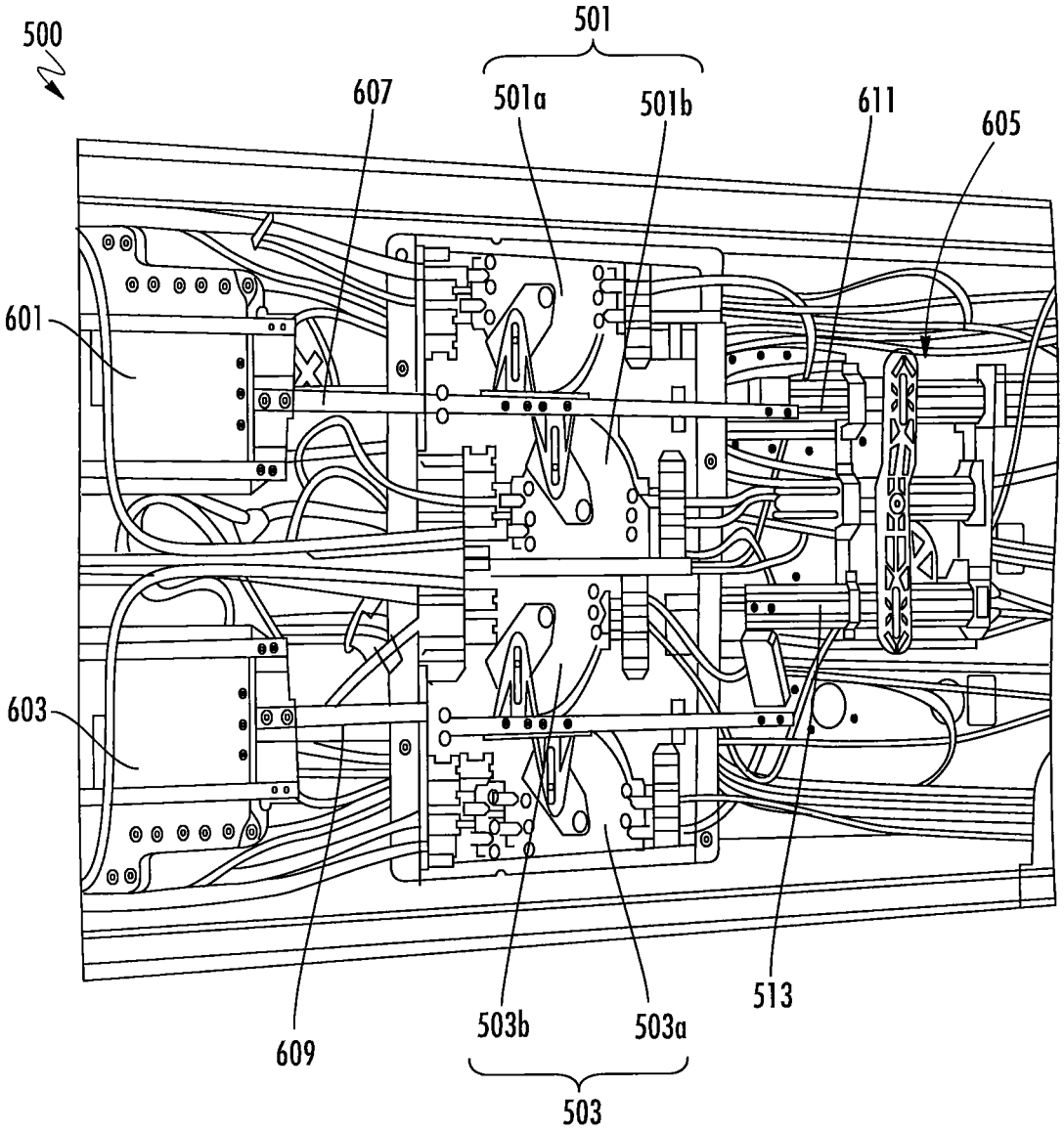
FIG. 6 is a perspective view of a portion of a backside of the diplexed antenna of FIGS. 5A-5C, according to an aspect of the present disclosure.

FIG. 6 is a perspective view of a portion of a backside of the diplexed antenna 500. Each of the first and second coarse phase shifters 501, 503 may include two wiper arc phase shifters 501*a*, 501*b*, 503*a*, 503*b*, respectively. For example, the first phase shifter 501 may include one wiper arc phase shifter 501*a* configured to adjust a phase shift for +45° polarization, and another wiper arc phase shifter 501*b* configured to adjust a phase shift for −45° polarization of the first frequency band. Similarly, the second coarse phase shifter 503 may include one wiper arc phase shifter 503*a* configured to adjust a phase shift for +45° polarization and another wiper arc phase shifter 503*b* configured to adjust a phase shift for −45° polarization of the second frequency band.

The first and second coarse phase shifters 501, 503 may be connected to respective first and second frequency band inputs 601, 603, and a tilt adapter 605 via respective connecting members 607, 609. More specifically, the connecting member 607 may be connected to the first frequency band input 601, the first phase shifter 501, and a first rod 611 of the tilt adapter 605. Similarly, the connecting member 609 may be connected to the second frequency band input 603, the second phase shifter 503, and a second rod 613 of the tilt adapter 605.

Figure 7:
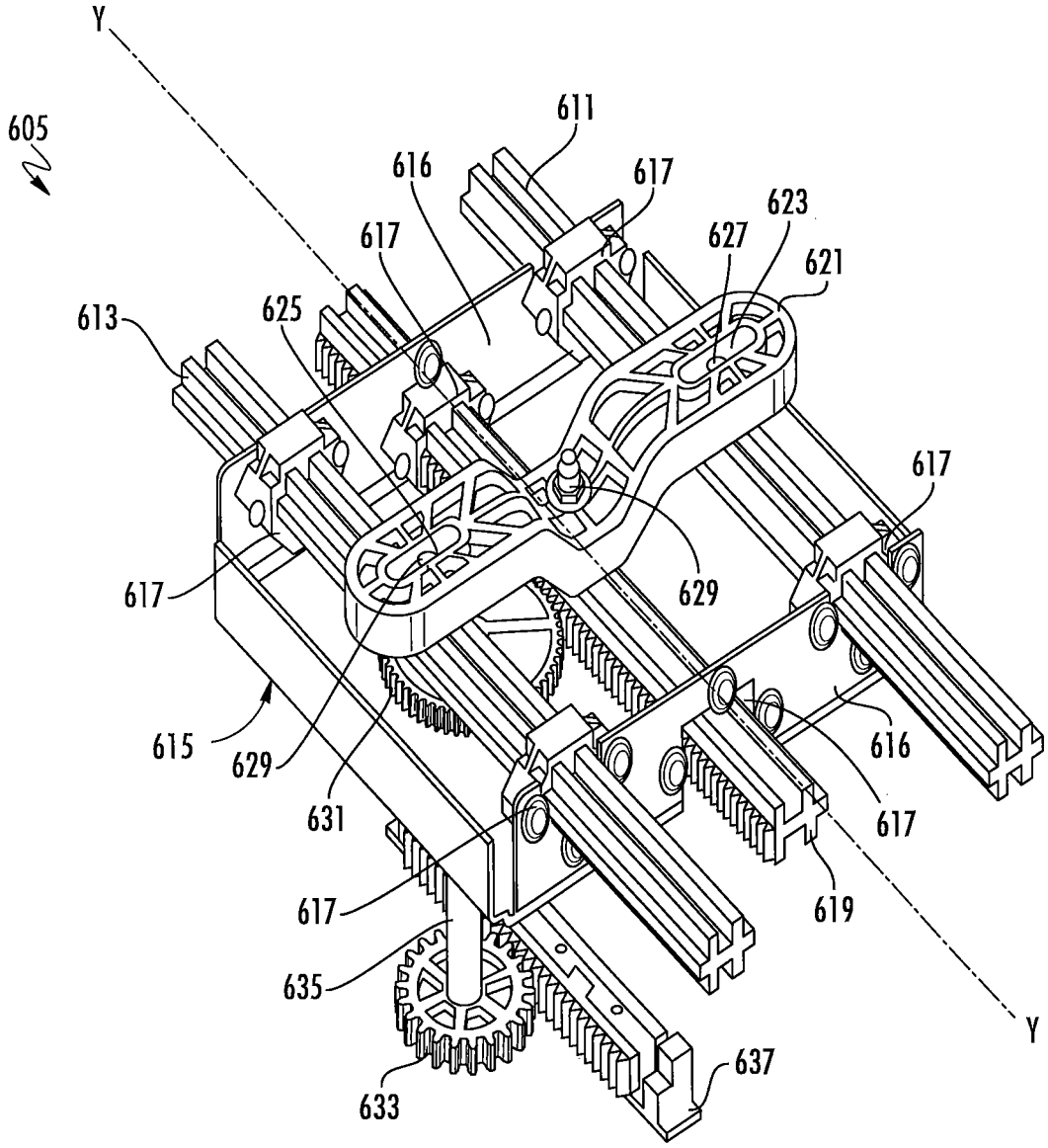
FIG. 7 is an enlarged perspective view of a tilt adapter, according to an aspect of the present disclosure.

FIG. 7 is an enlarged perspective view of the tilt adapter 605 which may be configured to effect the desired tilt of the first and second frequency bands of operation of the diplexed antenna 500. The tilt adapter 605 may include a chassis 615 defining a cavity within an interior thereof. Two opposing side walls 616 of the chassis 615 may include a plurality of respective openings 617 with which portions of a first level rack 619, the first level rod 611, and the second level rod 613 may be slidably engaged.

A cross linkage member 621 may be pivotably connected to the first level rack 619, the first level rod 611, and the second level rod 613, at a position between the two opposing side walls 616. The cross linkage member 621 may include slots 623, 625 positioned at opposing ends of the cross linkage member 621. Respective pins 627, 629 may be affixed to, and may extend from, the first and second level rods 611, 613. The respective slots 623, 625 may allow for movement of the respective pins 627, 629 within the respective slots 623, 625.

Consequently, lateral movement of the first level rod 611 may cause movement of the pin 627 within the slot 623 as well as effect rotational movement of the cross linkage member 621 about the pin 629 affixed to the second level rod 613. The rotational movement of the cross linkage member 621 may cause a center 629 of the cross linkage member 621 to move in the same lateral direction as the first level rod 611. The lateral movement of the center 629 of the cross linkage member 621 may, in turn, cause the first level rack 619 to move a distance in the same lateral direction as the first level rod 611. As discussed hereinthoughout, lateral movement may refer to linear movement along an axis Y-Y.

Similarly, lateral movement of the second level rod 613 may cause movement of the pin 629 within the slot 625 as well as effect rotational movement of the cross linkage member 621 about the pin 627 affixed to the first level rod 611. The rotational movement of the cross linkage member 621 may cause the center 629 of the cross linkage member 621 to move in the same lateral direction as the second level rod 613. The lateral movement of the center 629 of the cross linkage member 621 may, in turn, cause the first level rack 619 to move in the same lateral direction as the second level rod 613.

The first level rack 619 may be configured to move at a predetermined fraction of the distance travelled by either of the first and second level rods 611, 613. To effect the average of the set tilt values α, β, of the supported first and second frequency bands, the predetermined fraction may be ½. Stated differently, the first level rack 619 may be configured to move a lateral distance of ½ the distance moved by either of the first and second level rods 611, 613.

The first level rack 619 may be in toothed engagement with a first pinion gear 631 which may, in turn, be connected to a second pinion gear 633 via a shaft 635. The second pinion gear 633 may be in toothed engagement with a second level rack 637. As such, the above discussed lateral movement of the first level rack 619 may cause lateral movement of the second level rack 637. The lateral movement of the second level rack 637 may be in accordance with a gear ratio of the first level rack 619 to the second level rack 633.

More specifically, as the first level rack 619 moves laterally, the first pinion gear 631 may rotate, which, in turn, may cause rotation of the shaft 635, which may drive rotation of the second pinion gear 633. Further, rotation of the second pinion gear 633 may cause lateral movement of the second level rack 637, positioned on the frontside of the diplexed antenna 500 (e.g., opposite the backside) and coupled to the fine phase shifters 509, 511.

The various components of the tilt adapter 605 may be constructed of aluminum, or any material suitable to withstand the normal operating conditions of the diplexed antenna 500 without deviating from the inventive concept, such as other metals or polymeric materials.

Figure 8:
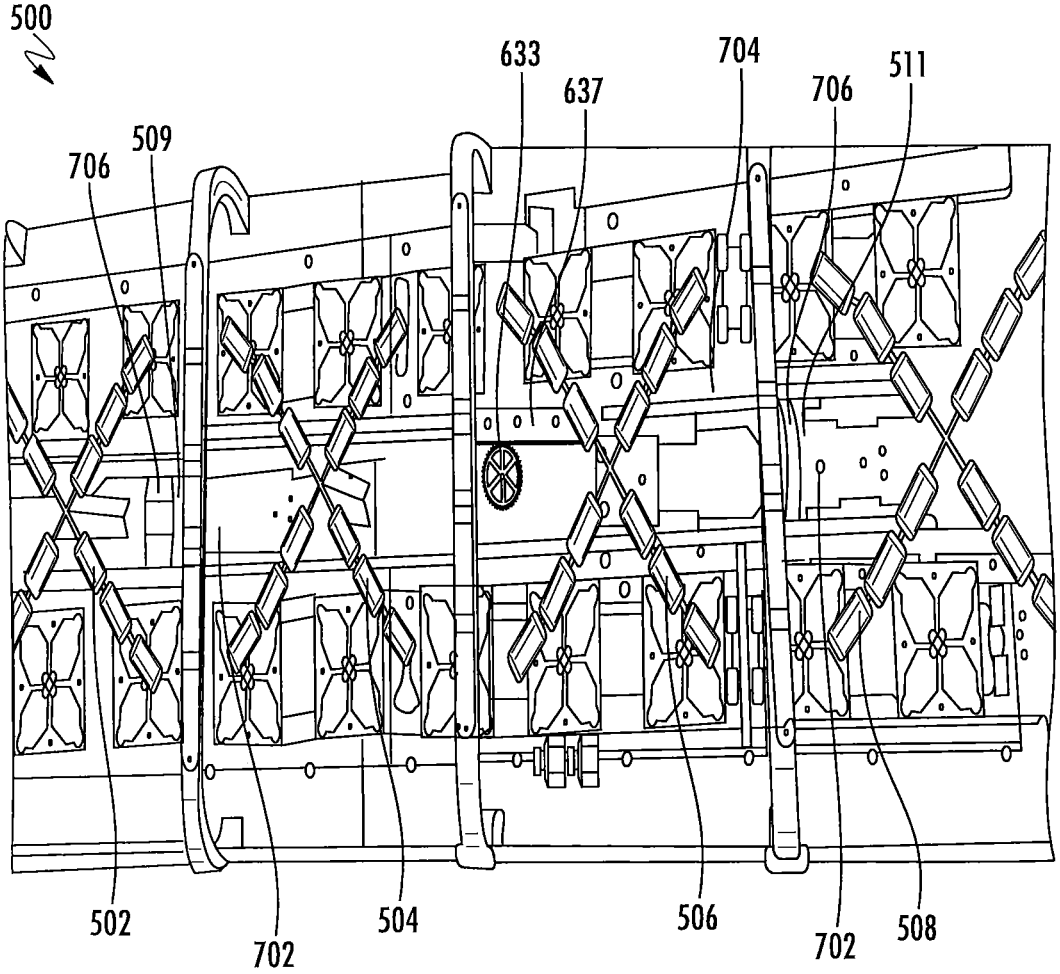
FIG. 8 is a perspective view of a portion of the frontside of the diplexed antenna of FIG. 6, according to an aspect of the present disclosure.
Figure 9:
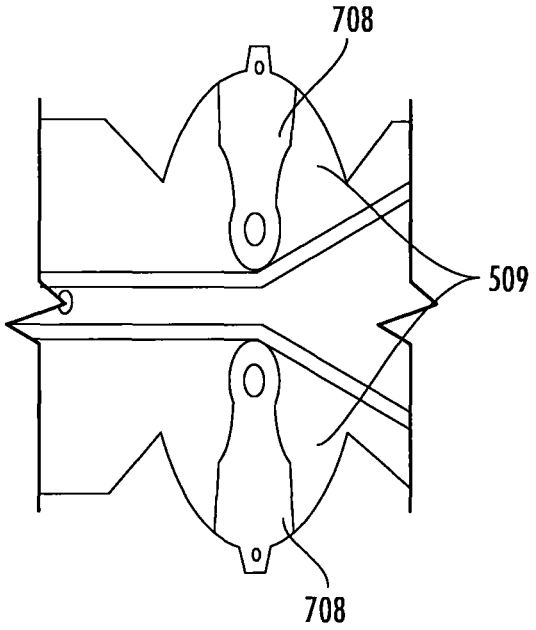
FIG. 9 is an enlarged view of a fine phase shifter according to an aspect of the present disclosure.

FIG. 8 is a perspective view of the frontside (e.g., opposite the backside) of the diplexed antenna 500 with a radome removed. The diplexed antenna 500 may include radiating elements 502, 504, 506, 508 which may be first and/or second band radiating elements mounted to one of the feed boards 702. Fine phase shifters 509, 511 may be integrated into one of the feed boards 702. The second level rack 637 may be connected to an elongated bar 704, which may couple each of the fine phase shifters 509, 511 to a wiper connecting bar 706, opposing ends of which may be connected to respective wiper arms 708 (as shown in FIG. 9) of the fine phase shifters 509, 511 (an example of one of the phase shifters 509 or 511 of which is shown in FIG. 9). As such, lateral movement of the second level rack 637 may cause lateral movement of the elongated bar 704. Such lateral movement of the elongated bar 704 may cause movement of one or more of the wiper connecting bars 706 resulting in movement of respective wiper arms 708 causing the fine level phase shift to effect the desired level of tilt.

In operation, in accordance with the input of the desired tilt value α, the connecting member 607 may move laterally, causing the first coarse phase shifter 501 to provide a first contribution on a first tilt associated with the first frequency band. In accordance with the input of the desired tilt value β, the connecting member 609 may move laterally, causing the second coarse phase shifter 503 to provide a second contribution on a second tilt associated with a second frequency band.

Lateral movement of the connecting members 607, 609 may cause movement of the respective first and second level rods 611, 613. Movement of the first and/or second level rods 611, 613 may cause movement of the first level rack 619, which, via the first pinion gear 631, shaft 635, and second pinion gear 633, may cause lateral movement of the second level rack 637. Lateral movement of the second level rack 637 may cause the first and second fine phase shifters 509, 511 to provide a phase shift based on a combination of the set tilt values α and β of the respective coarse phase shifters 501, 503.

It should be noted that the different antenna types may include a different number of radiating elements, which may result in different radiating element spacings and phase shifter arc radii. As such, the coarse phase shifters and fine phase shifters may be affected differently by such variations. For example, antennas of longer lengths may include a greater number of radiating elements, which may increase the distance between some phase shifter outputs measured in element spacings, while antennas of shorter lengths may include fewer radiating elements, which may result in a reduction of the distance between some phase shifter outputs. As discussed above, a phase shift value of a phase shifter may be proportional to the distance between each of the outputs of the phase shifter. For example, the coarse phase shifters' shift values may depend on the total number of radiating elements in the diplexed antenna, and, as such, the coarse phase shift values may be increased or decreased based on a length of the diplexed antenna. The phase shift values output from the fine phase shifters, however, may not be similarly affected. For example, to account for a greater number of radiating elements, diplexed antenna may employ additional feedboards including additional fine phase shifters to drive the same. As such, the distance between the outputs of each of the fine phase shifters may not change, or may not change in the same fashion as the outputs of the coarse phase shifters.

Because the coarse phase shifters and fine phase shifters are affected differently by the diplexed antenna types in which they are implemented, one or more components of the tilt adapter to which they are coupled may also need to be modified. To effect a proper coarse and fine phase shifting for different antenna types, the gear ratio may be adjusted to produce the desired movement of the second level rack 637 relative to the first level rack 619. For example, the diameter of the first pinion gear 631 and/or the second pinion gear 633 may be increased or decreased to account for different antenna types, such as other antenna types and arrangements discussed in U.S. patent application Ser. No. 14/812,339, the entire contents of which are incorporated herein by reference. For example, a diameter of the first pinion gear 631 may be increased, which, in turn, may increase the number of teeth along the circumference of the first pinion gear 631. This modification may result in an increased gear ratio. Alternatively, a diameter of the first pinion gear 631 may be decreased, which, in turn, may decrease the number of teeth along the circumference of the first pinion gear 631. This modification may result in a decreased gear ratio. The gear ratio may be modified in other techniques in keeping with the spirit of the disclosure.

As used herein, "input", "output", and some other terms or phrases refer to the transmit signal path. However, because the structures described herein may be passive components, the networks and components also perform reciprocal operations in the receive signal path. Therefore, the use of "input", "output", and some other terms is for clarity only, and is not meant to imply that the diplexed antennas do not operate concurrently in both receive and transmit directions.

Various aspects of the present disclosure have now been discussed in detail; however, the invention should not be understood as being limited to these specific aspects. It should also be appreciated that various modifications, adaptations, and alternative embodiments thereof may be made within the scope and spirit of the present invention.

What is claimed is:

1. A method for operating an antenna in first and second radiofrequency (RF) bands, the method comprising:

receiving first and second RF signals associated respectively with the first and second RF bands;

using a first electromechanical phase shifter to apply a first phase shift to the first RF signal, resulting in a plurality of first phase shifted RF signals;

using a second electromechanical phase shifter to apply a second phase shift to the second RF signal, resulting in a plurality of second phase shifted RF signals; and using a third electromechanical phase shifter to apply a third phase shift to at least some of the plurality of first phase shifted RF signals, and to at least some of the plurality of second phase shifted RF signals.

2. The method of claim 1, wherein the first and second electromechanical phase shifters are wiper arc phase shifters.

3. The method of claim 2, wherein the third electromechanical phase shifter is a sliding dielectric phase shifter.

4. The method of claim 1, wherein using the third electromechanical phase shifter to apply the third phase shift to at least some of the plurality of first phase shifted RF signals, and to at least some of the plurality of second phase shifted RF signals comprises diplexing a first phase shifted RF signal and a second phase shifted RF signal.

5. The method of claim 1, wherein an amount of the third phase shift is based on an amount of the first phase shift and an amount of the second phase shift.

6. The method of claim 5, wherein the amount of the third phase shift is based on an arithmetic mean of the first and second phase shifts.

7. The method of claim 1, wherein the first, second, and third electromechanical phase shifters are coupled to each other via a mechanical coupling.

8. The method of claim 7, wherein the mechanical coupling comprises:

a first member coupled to the first electromechanical phase shifter;

a second member coupled to the second electromechanical phase shifter;

a cross linkage member operatively engaged to both the first and second members;

a first moveable member coupled to the cross linkage member and configured to move in response to movement of the cross linkage member; and a second moveable member coupled to the third electromechanical phase shifter.

9. The method of claim 8, wherein the second moveable member is also coupled to a fourth electromechanical phase shifter.

10. The method of claim 1, wherein using the third electromechanical phase shifter to apply the third phase shift to at least some of the plurality of first phase shifted RF signals, and to at least some of the plurality of second phase shifted RF signals results in a plurality of third phase shifted RF signals, the method further comprising transmitting the plurality of third phase shifted RF signals via at least one radiating element of the antenna.

11. A method for operating an antenna in first and second radiofrequency (RF) bands, the method comprising:

receiving first and second RF signals associated respectively with the first and second RF bands;

applying a first phase shift to the first RF signal using a first electromechanical phase shifter, resulting in a plurality of first phase shifted RF signals;

applying a second phase shift to the second RF signal using a second electromechanical phase shifter, resulting in a plurality of second phase shifted RF signals; and applying a third phase shift to at least some of the plurality of first phase shifted RF signals and to at least some of the plurality of second phase shifted RF signals using a third electromechanical phase shifter, wherein an amount of the third phase shift is less than at least one of an amount of the first phase shift and an amount of the second phase shift.

12. The method of claim 11, wherein the amount of the third phase shift is based on an amount of the first phase shift and an amount of the second phase shift.

13. The method of claim 12, wherein the amount of the third phase shift is based on an arithmetic mean of the first and second phase shifts.

14. The method of claim 11, wherein the first, second, and third electromechanical phase shifters are coupled to each other via a mechanical coupling.

15. The method of claim 11, wherein applying the third phase shift to at least some of the plurality of first phase shifted RF signals, and to at least some of the plurality of second phase shifted RF signals results in a plurality of third phase shifted RF signals, the method further comprising transmitting the plurality of third phase shifted RF signals via at least one radiating element of the antenna.

16. A method for operating an antenna in first and second radiofrequency (RF) bands, the method comprising:

receiving first and second RF signals associated respectively with the first and second RF bands;

generating a plurality of first phase shifted RF signals by using a first electromechanical phase shifter to apply a first phase shift to the first RF signal;

generating a plurality of second phase shifted RF signals by using a second electromechanical phase shifter to apply a second phase shift to the second RF signal; and generating a plurality of third phase shifted RF signals by using a third electromechanical phase shifter to apply a third phase shift to at least some of the plurality of first phase shifted RF signals and at least some of the plurality of second phase shifted RF signals, wherein an amount of the third phase shift is based on an amount of the first phase shift and an amount of the second phase shift.

17. The method of claim 16, wherein the amount of the third phase shift is less than at least one of the amount of the first phase shift and the amount of the second phase shift.

18. The method of claim 16, wherein the amount of the third phase shift is based on an arithmetic mean of the first and second phase shifts.

19. The method of claim 16, wherein generating the plurality of first phase shifted RF signals and generating the plurality of second phase shifted RF signals are performed independently of each other.

20. The method of claim 16, further comprising transmitting the plurality of third phase shifted RF signals via at least one radiating element of the antenna.

* * * * *